United States Patent [19]

Geisen et al.

[11] Patent Number: 5,024,886

[45] Date of Patent: Jun. 18, 1991

[54] SEALING SHEETS FOR ROOFS

[75] Inventors: Pierre Geisen, Strasbourg; Jean-Claude Reillaudoux, Souffelweyersheim, both of France

[73] Assignee: Soprema S.A., Strasbourg, France

[21] Appl. No.: 247,540

[22] Filed: Sep. 22, 1988

[30] Foreign Application Priority Data

Dec. 24, 1987 [FR] France ..... 87 18467

[51] Int. Cl.[5] ..... B32B 11/04; B32B 7/12; B05D 1/36

[52] U.S. Cl. ..... 428/332; 427/222; 427/404; 427/407.1; 428/99; 428/343; 428/489; 428/500

[58] Field of Search ..... 428/354, 40, 492, 489, 428/500, 343, 332, 99; 427/404, 222, 407.1

[56] References Cited

U.S. PATENT DOCUMENTS

| | | | |
|---|---|---|---|
| 4,386,981 | 6/1983 | Clapperton | 428/40 X |
| 4,396,665 | 8/1983 | Rowe | 428/489 X |
| 4,559,267 | 12/1985 | Freshwalter et al. | 428/354 X |
| 4,589,804 | 5/1986 | Paeglis et al. | 428/492 X |

*Primary Examiner*—Thomas J. Herbert

*Attorney, Agent, or Firm*—Ostrolenk, Faber, Gerb & Soffen

[57] ABSTRACT

Sealing system for roofs by means of two successive sealing layers. The first sealing layer is mechanically attached to the support and the second, self-adhesive, sealing layer is attached to the first sealing layer by cold self-adhesion. The first sealing layer comprises sealing sheets made up by the assembling of one asphalt-base sheet reinforced by an armature and of a film of a polymer having a high tear resistance.

13 Claims, No Drawings

SEALING SHEETS FOR ROOFS

BACKGROUND OF THE INVENTION

1. Field of the Invention

The invention relates to a system for the sealing of roofs comprising a first sealing layer that is mechanically attached to a support to be protected, and a second self-adhesive sealing layer that is attached to the first sealing layer. It also relates to the constituents of that first sealing layer.

2. Brief Description of the Background of the Invention Including Prior Art

Various systems have been proposed for the sealing of roofs. The most frequently used system among them consists of applying a bituminous or asphalt coating in two layers, where the first layer is mechanically fixed to the support to be protected, whereas the second layer is welded with a welding torch onto the first layer. However, such a system is not always convenient since torch welding requires very specialized manpower and comprises certain obvious risks, since the support to be protected is flammable.

Moreover, the mechanical attaching of the first layer brings about the risk of perforation of the assembly by the screws or the rivets following the settling of the support and/or the movements of the structure.

Another sealing system consists in applying a self-adhesive sealing sheet directly onto the support to be protected, where the upper surface of the sealing sheet is protected by a film of a synthetic material. The jointing of the adjacent sheets is achieved either by partial overlapping or by applying of a complementary strip covering both edges of the two sheets.

However, the application of this type of self-adhesive material requires that the placement surface be even, clean, and without roughnesses and dust. It is therefore difficult to use this system on irregular supports such as thermal insulating materials or over old sealing coverings, for example, in the case of a sealing restoration or overhauling.

On the other hand, due to the total adherence, their sheets have to tolerate the movements of the support and therefore risk being rapidly damaged.

Furthermore, in case of the building-up of gas or water vapor between the support and the waterproof sheet due to a migration of humidity, there is brought about the risk that excessive pressure zones are created by these gases and that bubbles and swellings occur which can lead to the rupturing of the sealing sheet.

Finally, in very windy or breezy regions it is not always possible to obtain a sufficient adhesion of the self-adhesive sheet to its support.

SUMMARY OF THE INVENTION

1. Purposes of the Invention

It is an object of the present invention to avoid the problems of the known systems by proposing a sealing system that uses a sealing sheet of a novel type.

It is another object of the invention to provide a sealing system which is characterized by the successive application of two sealing layers, where the first layer is mechanically attached to the support to be protected, and the second self-adhesive layer is attached to the first layer by self-adhesion.

It is yet another object of the invention to provide sealing sheets which constitute the first layer of the sealing system according to the invention.

These and other objects and advantages of the present invention will become evident from the description which follows.

2. Brief Description of the Invention

The present invention provides for a sealing sheet for roofs. This sealing sheet may be the first layer applied to the roof according to the method invention to be described below. An asphalt-base sheet of this first layer has an upper surface. A film of a polymer having a high tear resistance covers the upper surface of the asphalt-base sheet. The polymer can be selected from the group consisting of polyethylene, polypropylene and mixtures thereof. The film can be a double-stretched polyethylene film marketed under the name "VALERON." The film can have a thickness of between 10 and 200 micrometers.

The asphalt-base sheet can be reinforced by a reinforcement of organic or mineral fibers. The sheet can be composed of an asphalt base modified by an elastomer.

The film and the sheet can be assembled by glueing by means of a glue providing sufficient adhesion.

A sealing method for roofs can comprise the following. A first sealing layer is applied to a support to be protected by mechanically attaching the first sealing layer to the said support. The first sealing layer is an asphalt-base sealing sheet with the upper surface covered with a film of a polymer having a high tear resistance. A self-adhesive second sealing layer is attached to the first sealing layer by cold self-adhesion.

A second sealing layer can be an asphalt-base sealing sheet or a plurality thereof comprising a self-adhesive under-surface protected by a silicone treated protection sheet, which silicone-treated protection sheet can be removed at the time of use.

The surface of the second layer of sealing sheets is self-protected by a material selected from the group consisting of metallic sheets, mineral granules, and films of a synthetic material having a high chemical resistance.

The first-layer sealing sheets according to the present invention are made up by assembling together an asphalt-bitumen-base sheet reinforced with an armature, and a film material. The material of this film exhibits the dual property of having a considerable tear and crack resistance and of permitting a good adhesion of the self-adhesive sheet that constitutes the second layer of the sealing system according to the invention.

The asphalt-bitumen sealing sheets provided for the embodiment of the sealing sheets according to the invention can be any asphalt-oxidized bitumen or modified asphalt-bitumen sheets that are reinforced by an armature of mineral or organic fibers. The sheets can thus be comprises of asphalt-bitumen modified by an elastomer or by a thermoplastic polymer of the styrene-butadiene-styrene type, covering or coating a reinforcement such as a woven or non-woven ply or web of glass, polyester, polypropylene, or polyamide.

The film used for the embodiment of the sealing sheets according to the invention must, as already stated, exhibit the dual property of offering great resistance against wear and tear and of permitting good adhesion of the self-adhesive sheet constituting the second layer of the sealing system according to the invention.

Such a film can consist of a film of synthetic material, such as polyethylene or propylene having a thickness of from 10 to 200 micrometers and, preferably, of 40 micrometers.

Advantageously, it can be made out of a double-stretched polyethylene film such as the film marketed by the company VAN LEER under the name "VALERON."

The first-layer sealing sheets according to the invention are obtained by adhesion of such a film onto an asphalt-based sealing sheet of the known type. This adhesion can be carried out by means of an appropriate adhesive such as a dissolved asphalt-bituminous glue or a cross-linkable resin-base glue.

The first-layer sealing sheets according to the invention exhibit the particularly advantageous aspect of offering a remarkable resistance to tear as well as an excellent adherence with respect to the self-adhesive sheets that constitute the second layer of the sealing system according to the invention.

The sealing system according to the invention thus has the considerable advantage of offering a double security due, on the one hand, to the use of two sealing layers, one of which is perfectly sealed in itself and, of the other hand, to the perfect adherence of the second layer to the first layer.

The sheets used for producing the second sealing layer of the sealing system according to the invention are asphalt-bitumen-base sealing sheets comprising a self-adhesive underface that is protected by a detachable protection sheet, for example, paper or silicone-treated polypropylene. Their upper surface can advantageously be protected either by fine flakes or by mineral granules, or even by a metallic sheet or a film of synthetic material having a high chemical resistance.

The sheets can furthermore comprise an armature of mineral or organic fibers such as a woven or non-woven ply of glass, polyester, polypropylene, or polyamide.

The novel features which are considered as characteristic for the invention are set forth in the appended claims. The invention itself, however, both as to its construction and its method of operation, together with additional objects and advantages thereof, will be best understood from the following description of specific embodiments.

DETAILED DESCRIPTION OF PREFERRED EMBODIMENT

In accordance with one aspect of the present invention, there is provided a sealing sheet for roofs which comprises an asphalt-base sheet, covered at its upper surface with a film of a polymer having a high tear resistance. The polymer can be chosen from the group formed by polyethylene and polypropylene. The film can be a double-drawn polyethylene film marketed under the name "VALERON." The film can have a thickness of between 10 and 200 micrometers.

The asphalt-base sheet can be reinforced by an armature of organic or mineral fibers. The sheet can be of an asphalt base modified by an elastomer.

The film and the sheet can be assembled by glueing by means of an appropriate glue.

A sealing system and method according to other aspects of the invention comprises the application of two sealing layers to the support to be protected. The first sealing layer is mechanically attached to the said support and comprises an asphalt-base sealing sheet, covered at its upper surface with a film of a polymer having a high tear resistance. The second sealing layer is self-adhesive and is attached to the first sealing layer by cold self-adhesion.

The second sealing layer can be made of asphalt-base sealing sheets comprising a self-adhesive under-surface protected by a silicone-treated protection sheet that can be removed at the time of use.

The surface of the second-layer sealing sheets can be self-protected by a material selected from the group consisting of metallic sheets, mineral granules, and films of a synthetic material having a high chemical resistance.

The implementation of the system according to the invention is carried out first by dry-placing the first-layer sealing sheets according to the invention onto the support. These sealing sheets are attached at their edges by mechanical fixing means such as screws, nails, or rivets, preferably outfitted with washers or division inserts. Each sheet is partially covered, on the mechanically fixed edge, by the following sheet, which is attached thereto by glueing along the overlapping selvedge. This glueing and adhesion attaching can be carried out by means of cold glue such as an asphalt-binder-base glue or a glue that has a base of a reactive synthetic resin, for example a glue that has a polyurethane or epoxy resin base.

The second sealing layer is attached to this first layer, in a second layer application, by simple unrolling, placing, and application of the self-adhesive sheets, from which the silicone-treated protection sheet has been removed. The seams between the two adjacent sheets are secured by partial overlapping and obtained by simple self-adhesion joints.

Apart from the advantage of double security already stated above, the sealing system according to the invention has the added advantage that it is extremely easy to work with. It does not require torch-welding and thus eliminates the inherent risks of a fire on a building site.

The mechanical attached of the first sealing layer offers the subsidiary advantage that said sealing layer can be put in place on any support to which the layer can be attached by screws or rivets, such as, for example, wood or wood panels, metal, or concrete. This can be achieved without said support exhibiting the surface quality required for the prior art first sealing layers attached by self-adhesion mentioned above.

Compared to attaching by glueing, this mechanical attaching offers likewise the advantage of allowing the gases or vapors, that might build between the support and the first layer, to regularly break up under this first layer, thus avoiding the blister phenomena.

As an example of a sealing sheet according to the invention, one can be cited where the composition and characteristics are as follows:

Bonding material: asphalt-bitumen elastomer styrene-butadiene-styrene

Armature: glass fibers 50 g/sq.m

Surface films: polyethylene sheet of a thickness of 40 micrometers

Nominal thickness: 2 mm

It will be understood that each of the elements described above, or two or more together, may also find a useful application in other types of sealing sheets differing from the types described above.

While the invention has been illustrated and described as embodied in the context of sealing sheets for roofs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A composite sealing sheet for roofs comprising two layers, the first layer comprising a non-adhesive asphalt-base sheet, with a film of a polymer having a high tear resistance applied directly to its upper surface; and the second sealing layer comprising an asphalt-base sealing sheet having a self-adhesive under-surface which si applied directly to said first sealing layer.

2. The sealing sheet according to claim 1, where said film and said sheet are assembled by glueing by means of an appropriate glue.

3. The sealing sheet according to claim 1, where said polymer is chosen from the group formed by the polyethylene and the polypropylene.

4. The sealing sheet according to claim 3, where said film has a thickness of between 10 and 200 micrometers.

5. The sealing sheet according to claim 3, where said film is a double-drawn polyethylene film marketed under the name "VALERON."

6. The sealing sheet according to claim 1, where the asphalt-base sheet is reinforced by an armature of organic or mineral fibers.

7. The sealing sheet according to claim 6, where said sheet is of an asphalt base modified by an elastomer.

8. A sealing assembly for sealing roofs or the like, comprising two sealing layers applied to the support to be protected, the first sealing layer being mechanically attached to said support and comprising a non-adhesive asphalt-base sealing sheet, with a film of a polymer having a high tear resistance applied directly to its upper surface, and the second sealing layer being self-adhesive and being attached to the first sealing layer by cold self-adhesion.

9. The sealing assembly according to claim 8, where the second sealing layer comprises asphalt-base sealing sheets comprising a self-adhesive under-surface which is applied directly to said first sealing layer.

10. The sealing assembly according to claim 9, where the surface of said sealing sheets of said second layer is self-protected by a material selected from the group consisting of metallic sheets, mineral granules, and films of a synthetic material having a high chemical resistance.

11. A sealing method for roofs comprising the steps of:

applying a first sealing layer to a support to be protected, by mechanically attached the first sealing layer to said support, wherein the first sealing layer comprises a non-adhesive asphalt-base sealing sheet with a film of a polymer having a high tear resistance applied directly to its upper surface; and attaching a self-adhesive second sealing layer to the first sealing layer by cold self-adhesion.

12. The sealing method according to claim 11, further comprising the step of supplying the second sealing layer as one or more asphalt-base sealing sheets comprising a self-adhesive under-surface directly applied to said first sealing layer.

13. The sealing method according to claim 12, further comprising the step of self-protecting the surface of said sealing sheets of said second layer by means of a material selected from the group consisting of metallic sheets, mineral granules, and films of a synthetic material having a high chemical resistance.

* * * * *